US007693445B2

(12) United States Patent
Horrall et al.

(10) Patent No.: US 7,693,445 B2
(45) Date of Patent: Apr. 6, 2010

(54) CLEANER UNITS AND METHODS FOR REMOVING WASTE TONER WITHIN AN IMAGE FORMING DEVICE

(75) Inventors: Paul Douglas Horrall, Lexington, KY (US); Stacy Marie Pargett, Richmond, KY (US); Jennifer Marie Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 845 days.

(21) Appl. No.: 11/426,958

(22) Filed: Jun. 28, 2006

(65) Prior Publication Data

US 2008/0038012 A1 Feb. 14, 2008

(51) Int. Cl.
*G03G 21/00* (2006.01)

(52) U.S. Cl. ..... 399/101; 399/297

(58) Field of Classification Search ..... 399/98–101, 399/297

See application file for complete search history.

(56) References Cited

U.S. PATENT DOCUMENTS

| | | | | |
|---|---|---|---|---|
| 6,035,158 | A * | 3/2000 | Asakura et al. | 399/102 |
| 6,692,882 | B2 | 2/2004 | Oshiba et al. | |
| 6,701,122 | B2 | 3/2004 | Maeshima et al. | |
| 6,819,905 | B2 | 11/2004 | Yamatani | |
| 7,043,189 | B2 | 5/2006 | Blair et al. | |

OTHER PUBLICATIONS

Machine translation of JP 2001-296711 A.*

* cited by examiner

*Primary Examiner*—David M Gray
*Assistant Examiner*—Ruth N Labombard

(57) ABSTRACT

The present application is directed to cleaner units and methods for removing waste toner from a transfer member within an image forming device. The device may include a blade that is positioned against the transfer member to remove the waste toner. The blade directs the waste toner into a cleaner house where the waste toner is removed. The cleaner unit is positioned within the image forming device to prevent contact with the media sheets moving along the media path. The cleaner unit may also be positioned to utilize existing elements to facilitate the removal of the waste toner from the transfer member.

20 Claims, 3 Drawing Sheets

CLEANER UNITS AND METHODS FOR REMOVING WASTE TONER WITHIN AN IMAGE FORMING DEVICE

BACKGROUND

The present application is directed to image forming devices and, more particularly, to devices and methods for removing waste toner from a transfer member within an image forming device.

Image forming devices, such as color laser printers, produce images on print media that pass along a media path. The images are formed by one or more toner images that are formed on a transfer member and then transferred to the media sheets. During transfer of the toner images to the media sheets, some of the toner is not transferred and remains on the transfer member. This non-transferred toner, or waste toner, should be removed from the transfer member. Waste toner that remains on the transfer member may be inadvertently transferred to a subsequent media sheet resulting in a print defect.

A cleaner unit should remove the waste toner to an extent to prevent or greatly reduce the likelihood of print defects. Preferably, the cleaner unit should be constructed to not greatly increase the overall cost of the device. The current market for image forming devices is extremely competitive and price points may drive a purchasing decision for consumers. It is preferable that the device be able to produce high quality images and still be competitively priced.

The transfer member may move around a series of rollers as it receives the toner images and transfers them to the media sheets. The cleaner unit may be positioned opposite from one of the rollers to provide good contact with the transfer member. Prior art devices have positioned the cleaner unit in a manner for gravity to assist in the removal of the waste toner from the transfer member.

SUMMARY

The present application is directed to cleaner units and methods for removing waste toner from a transfer member within an image forming device. In one embodiment, the device may include a blade that is positioned against the transfer member to remove the waste toner. The blade directs the waste toner into a cleaner house where it can be removed. The cleaner unit is positioned within the image forming device to prevent contact with the media sheets moving along the media path. The cleaner unit may also be positioned to utilize existing elements to facilitate the removal of the waste toner from the transfer member.

DETAILED DESCRIPTION

The present application is directed to devices and methods for removing waste toner from a transfer member within an image forming device. The devices and methods remove the waste toner to prevent the waste toner from inadvertently being placed on a media sheet and causing a print defect.

In one embodiment, the image forming device comprises a color laser printer. The printer may be sized to fit on a workspace, such as a desktop. A user may use the printer to produce monochrome and/or color images. The printer further includes accessible work areas to allow the user to insert and remove media sheets, and clear media jams from the interior of the printer.

Figure 1:
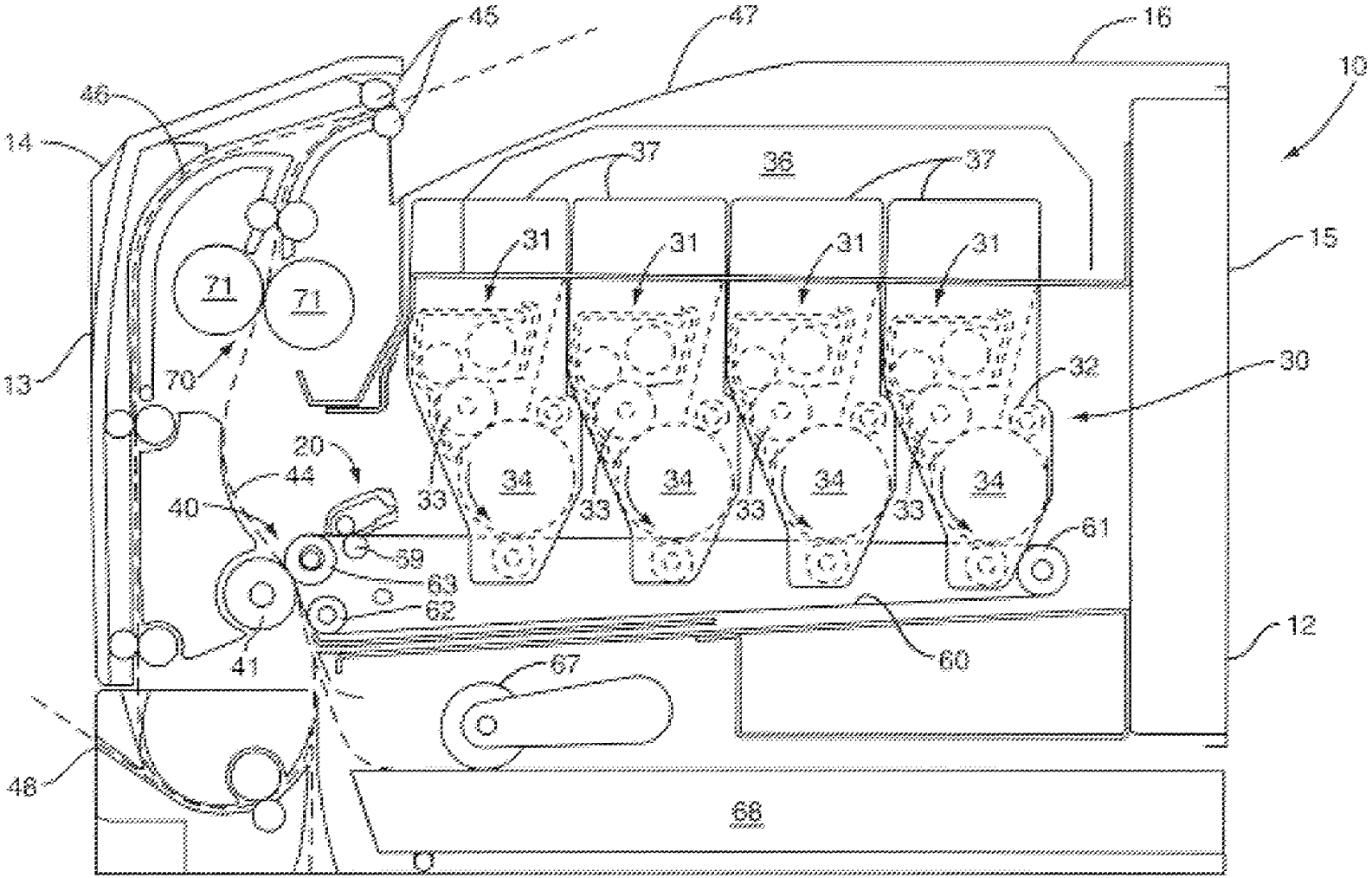
FIG. 1 is a schematic view of an image forming device according to one embodiment.

FIG. 1 illustrates one embodiment of an image forming device, generally illustrated as 10. The device 10 includes a media input tray 68 positioned in a tower section of a body 12. The tray 68 is sized to contain a stack of media sheets that will receive color and/or monochrome images. The media input tray 68 is preferably removable for refilling. Therefore, in this embodiment, a user may insert and remove the media input tray 68 from the device 10 through a front 13 of the body 12. A control panel 14 may be located on the front 13 of the body 12. Using the control panel 14, the user is able to enter commands and generally control the operation of the image-forming device 10. For example, the user may enter commands to switch modes (e.g., color mode, monochrome mode), view the number of images printed, take the device 10 on/off line to perform periodic maintenance, and the like.

A first toner transfer area 30 includes one or more imaging units 31 that are aligned horizontally extending from the front 13 to a back 15 of the body 12. Each imaging unit 31 includes a charging roll 32, a developer roll 33, and a rotating photoconductive (PC) drum 34. The charging roll 32 forms a nip with the PC drum 34, and charges the surface of the PC drum 34 to a specified voltage such as −1000 volts, for example. A laser beam 35 from a printhead 36 contacts the surface of the PC drum 34 and discharges those areas it contacts to form a latent image. In one embodiment, areas on the PC drum 34 illuminated by the laser beam 35 are discharged to approximately −300 volts. The developer roll 33, which also forms a nip with the PC drum 34, then transfers toner particles from a toner reservoir 37 to the PC drum 34 to form a toner image. The toner particles are attracted to the areas of the PC drum 34 surface discharged by the laser beam 35.

A toner reservoir 37 is operatively connected to each of the imaging units 31. The toner reservoirs 37 are sized to contain toner that is transferred to the imaging units 31 for image formation. The toner reservoirs 37 may be mounted and removed from the device 10 independently from the imaging units 31. In one embodiment, the toner reservoirs 37 each contain one of black, magenta, cyan, or yellow toner. Each of toner reservoirs 37 may be substantially the same, or one or more of the toner reservoirs 37 may hold different toner capacities. In one specific embodiment, the black toner reservoir has a higher capacity than the others. The toner reservoirs 37 may mount from a top 16 of the device 10, and may detach during removal with the imaging units 31 remaining within the device 10.

An intermediate transfer mechanism (ITO) 60 is disposed adjacent to each of the imaging units 31. In this embodiment, the ITM 60 is formed as an endless belt trained about support rollers 61, 62 and back-up roller 63. Other embodiments may feature the ITM 60 as a drum that rotates past each of the PC drums 34. During image forming operations, the ITM 60 moves past the imaging units 31 in a clockwise direction as viewed in FIG. 1. One or more of the PC drums 34 apply toner images in their respective colors to the ITM 60. In one embodiment, a positive voltage field attracts the toner image from the PC drums 34 to the surface of the moving ITM 60.

The ITM 60 rotates and collects the one or more toner images from the imaging nits 31 and then conveys the toner images to a media sheet at a second transfer area 40. The second transfer area 40 includes a nip formed between the back-up roller 63 and a second transfer roller 41. A cleaner unit 20 is positioned downstream from the second transfer area 40 to remove waste toner that remains on the ITM 60.

A media path 44 extends through the device 10 for moving the media sheets through the imaging process. Media sheets are initially stored in the input tray 68 or introduced into the body 12 through a manual feed 48. The sheets in the input tray 68 are picked by a pick mechanism 67 and into the media path 44. In this embodiment, the pick mechanism 67 includes a roller positioned at the end of a pivoting arm. The roller rotates to move the media sheets from input tray 68 towards the second transfer area 40. In one embodiment, the pick mechanism 67 is positioned in proximity (i.e., less than a length of a media sheet) to the second transfer area 40 with the pick mechanism 67 moving the media sheets directly from the input tray 68 into the second transfer area 40. For sheets entering through the manual feed 48, one or more rollers are positioned to move the sheet into the second transfer area 40.

The media sheet receives the toner image from the ITM 60 at the second transfer area 40. The media sheets with toner images are then moved along the media path 44 and into a fuser area 70. Fuser area 70 includes fusing rollers or belts 71 that form a nip to adhere the toner image to the media sheet. The fused media sheets then pass through exit rollers 45 that are located downstream from the fuser area 70. Exit rollers 45 may be rotated in either forward or reverse directions. In a forward direction, the exit rollers 45 move the media sheet from the media path 44 to an output area 47. In a reverse direction, the exit rollers 45 move the media sheet into a duplex path 46 for image formation on a second side of the media sheet.

Figure 2:
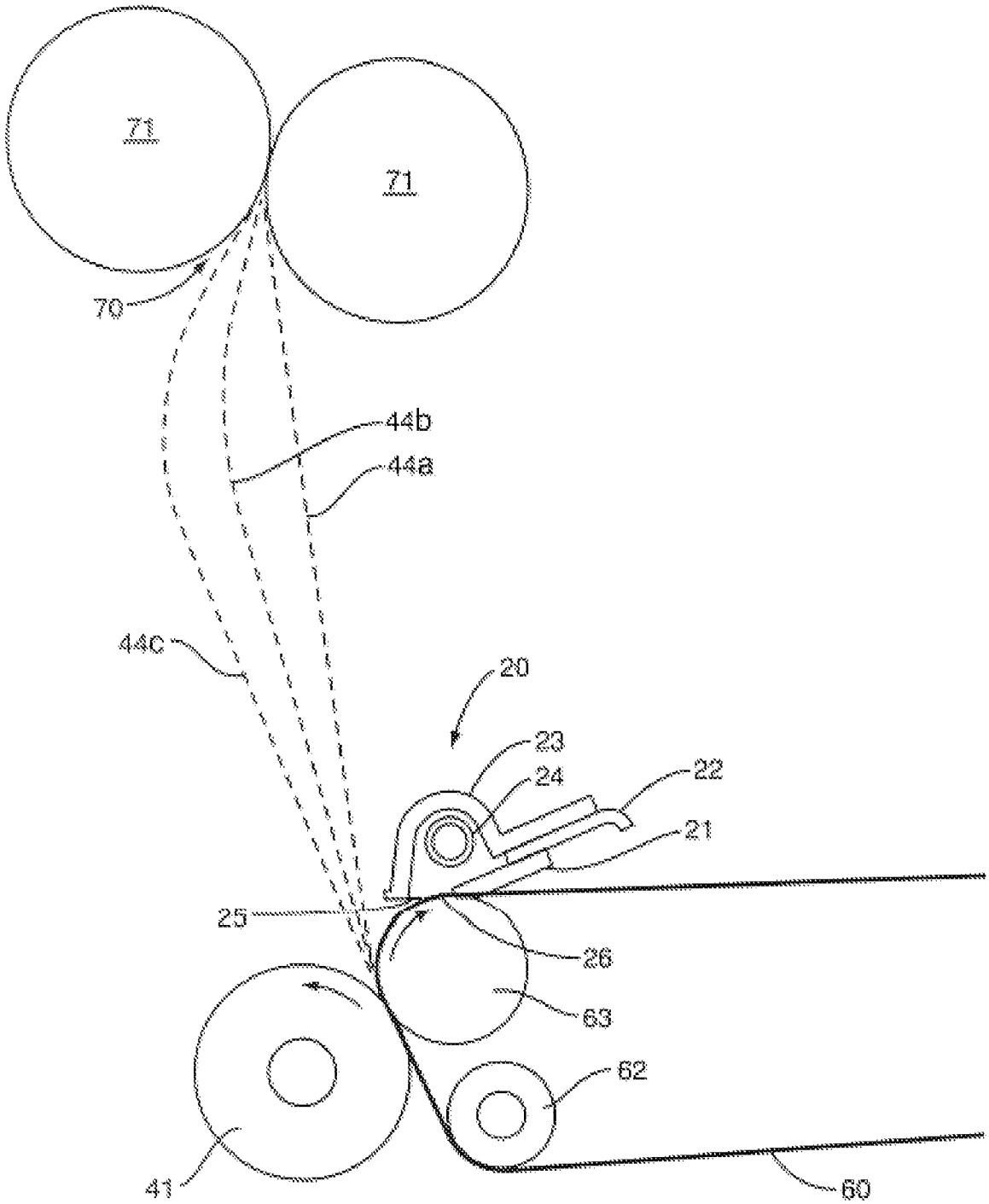
FIG. 2 is a schematic view of a cleaner unit and possible media paths according to various embodiments.
Figure 3:
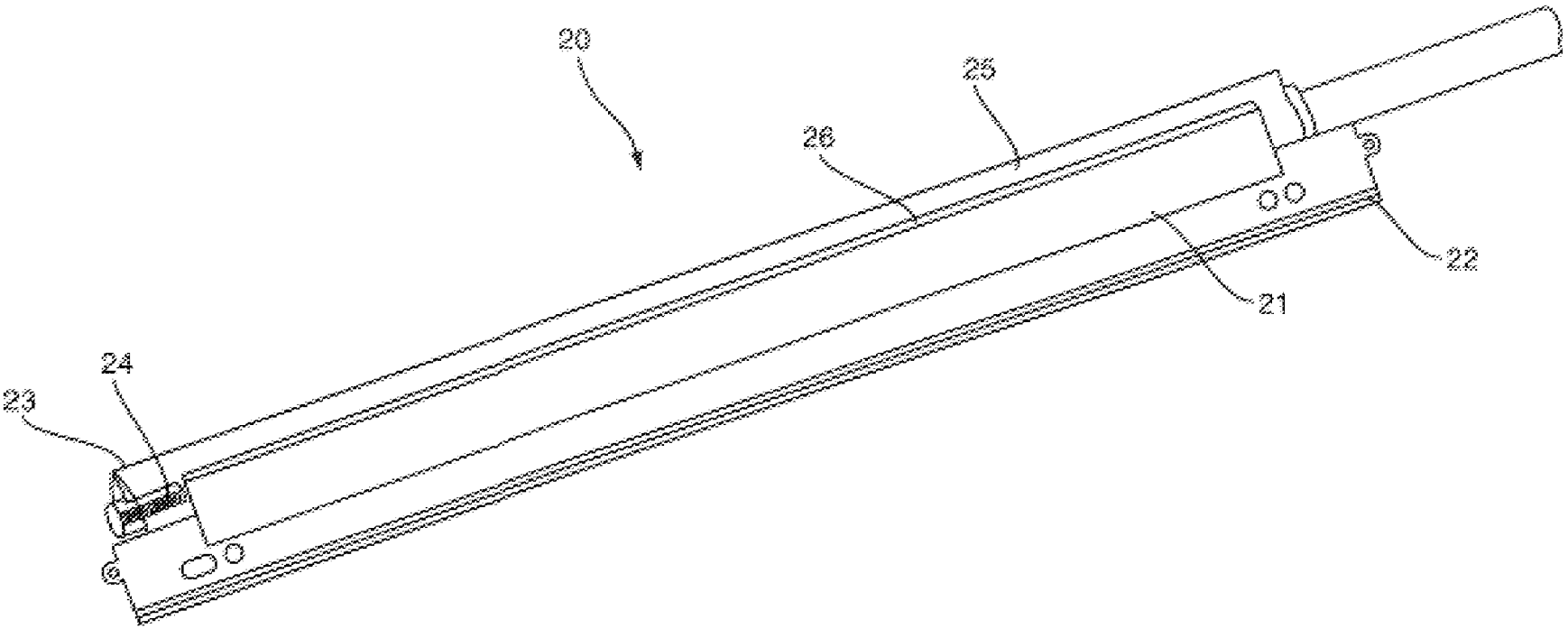
FIG. 3 is a perspective view of a cleaner unit constructed according to one embodiment.

The cleaner unit 20 removes waste toner form the ITM 60. FIG. 2 illustrates one embodiment of the cleaner unit 20 that is positioned at the back-up roller 63. A blade 21 abuts against the ITM 60, removes the waste toner form the ITM 60, and directs the accumulated waste toner into an opening 26 formed between the blade 21 and a lower seal 25. The blade 21 contacts the ITM 60 at a position where the ITM 60 is in contact with the back-up roller 63. The back-up roller 63 supports the ITM 60 to prevent sagging which would limit the effectiveness of the blade 21 to remove the waste toner. The blade 21 is positioned vertically above the back-up roller 63, and downstream from the second transfer roller 41 relative to the direction of movement of the ITM 60. In one embodiment, the back-up roller 63 includes a diameter that is less than about 27 mm. In one specific embodiment, the roller 63 includes a diameter less than about 25 mm.

The cleaner unit 20 may further include a bracket 22 that provides a support for attachment of the blade 21. A housing 23 may form an interior space adjacent to the blade 21. An auger 24 is positioned within the housing 23. Auger 24 may include helical blades with rotation of the auger 24 causing the waste toner to be moved within the cleaner unit 21. In one embodiment, the auger 24 leads into a waste toner reservoir (not illustrated) for storing the waste toner.

The bracket 22 may be mounted within the body 12 of the device 10 to position the cleaner unit 20 in proximity to the ITM 60. The blade 21 is positioned to contact and remove the waste toner from the ITM 60 and direct it into an opening 26 formed between the blade 21 and a lower seal 25. The opening 26 leads into the housing 23 that contains the waste toner. The auger 24 is positioned within the housing 23 to move the waste toner along the length of the cleaner unit 20. In the embodiment of FIG. 2, the auger is positioned vertically above the contact point of the blade 21 against the ITM 60, and also above the opening 26.

In use, the toner image is transferred to the media sheet as the sheet moves through the nip formed between the second transfer roller 41 and the back-up roller 63. Some toner is not transferred to the media sheet and remains on ITM 60 after passing through the second transfer area 40. The ITM 60 continues to rotate and the waste toner is brought into contact with the blade 21. The blade 21 contacts and moves the waste toner form the ITM 60 and into the opening 26 formed between the blade 21 and the lower seal 25. The lower seal 25 further keeps the waste toner that is cleaned from the ITM 60 inside the housing 23. The waste toner is then moved by the auger 24 within the length of the housing 23 and to a storage reservoir.

In the embodiment of FIG. 2, the cleaner unit 20 is positioned substantially inverted with the auger 24 positioned vertically above the blade 21 and the opening 26. The opening 26 through which the waste toner enters into the housing 23 is facing downward in the direction of gravity. The cleaner unit 20 is further positioned away from the media path 44 to prevent the media sheet from contacting the cleaner unit 20 after passing through the second transfer area 40. In one embodiment, the media path 44*a* is a substantially straight line that extends directly between the nip formed between the fuser members 71 and the nip formed at the second transfer between the second transfer roller 41 and the back-up roller 63. The cleaner unit 20 is offset from this media path 44*a* to prevent inadvertent contact after the media sheets move beyond the second transfer area 40. In one specific embodiment, the cleaner unit 20 is offset by about 2.14 mm from the media path 44*a*. Other media paths 44*b*, 44*c* may further be positioned and deflected further away from the cleaner unit 20 to prevent inadvertent contact.

As best illustrated in FIG. 1, the cleaner unit 20 may be positioned vertically above the ITM 60, the back-up roller 63, and the transfer roller 41. The cleaner unit 20 may be positioned on a substantially horizontal section of the intermediate transfer member 60 and the transfer roller 41 is positioned on a substantially vertical section of the intermediate transfer member 60.

Placement of the cleaner unit 20 on the back-up roller 63 is a cost saving measure as the back-up roller 63 can be used for multiple functions. Further, the back-up roller 63 has a generally large diameter that facilitates positioning of the cleaning blade 21. In some embodiments, the diameter of the back-up roller 63 is between about 17 mm and 25 mm. Generally, a dedicated cleaning roller has about a 6 mm diameter making it more difficult to place the blade 21.

In some embodiments, the cleaner unit 20 is used in combination with a dedicated cleaning roller 69. FIG. 1 illustrates an embodiment with the cleaner unit 20 positioned against a dedicated cleaning roller 69. The cleaning roller 69 is positioned downstream from the back-up roller 63.

Terms such as "first", "second", and the like, are also used to describe various elements, regions, sections, etc and are also not intended to be limiting. Like terms refer to like elements throughout the description. As used herein, the terms "having", "containing", "including", "comprising" and the like are open ended terms that indicate the presence of stated elements or features, but do not preclude additional elements or features. The articles "a", "an", and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An image forming device comprising:

an image forming unit to form a toner image;

an intermediate transfer member rotatably mounted within the image forming device to receive the toner image from the image forming unit, the intermediate transfer member including a first side that receives the toner image and a second side;

a back-up roller positioned in contact with the second side of the intermediate transfer member;

a transfer roller in contact with the first side of the intermediate transfer member and forming a transfer nip with the back-up roller to transfer the toner image to a media sheet; and a cleaner unit in contact with the first side of the intermediate transfer member and downstream from the transfer roller relative to rotation of the intermediate transfer member, the cleaner unit including a housing having a bracket attached to a lower portion thereof, the bracket securing a blade that contacts the first side of the intermediate transfer member at a position where the second side of the intermediate transfer member contacts the back-up roller to remove waste toner from the intermediate transfer member, the cleaner unit further including an auger disposed within the housing and positioned vertically above the blade, the housing having a curved, concave inner surface shaped to at least partly circumscribe the auger, wherein the lower portion of the housing further includes an outwardly extending planar portion to which is attached a planar portion of the bracket.

2. The device of claim 1, wherein the cleaner unit and the image unit arc each positioned on a horizontal section of the intermediate transfer member, and the transfer roller is positioned on a vertical section of the intermediate transfer member.

3. The device of claim 1, wherein a diameter of the back-up roller is less than about 27 mm.

4. The device of claim 1, wherein the cleaner unit is positioned vertically above the transfer roller.

5. The device of claim 1, further comprising a media path to move the media sheet and extending through the transfer nip formed by the transfer roller and the back-up roller, the cleaner unit being positioned away from the media path to prevent contact with the media sheet.

6. The device of claim 1, wherein the intermediate transfer member is a flexible belt that extends around the back-up roller and a plurality of support rollers.

7. The device of claim 6, wherein the back-up roller includes a diameter that is equal to or larger than any of the plurality of support rollers.

8. An image forming device comprising:

an intermediate transfer member rotatably mounted within the image forming device;

a transfer nip formed between a transfer roller and a back-up roller, the intermediate transfer member extending through the transfer nip;

a cleaner unit comprising a blade and a seal that form an opening that leads into a housing that contains an auger with the auger being positioned vertically above the opening; and the cleaner unit including a bracket attached to a lower portion of the housing, the bracket securing the blade contacting and abutting the intermediate transfer member against the back-up roller to remove and direct the waste toner through the opening and into the housing, the housing having a curved, concave inner surface to at least partly circumscribe the auger, wherein the lower portion of the housing further includes an outwardly extending planar portion to which is attached a planar portion of the bracket.

9. The device of claim 8, wherein the intermediate transfer member is a flexible belt.

10. The device of claim 9, wherein the flexible belt includes a first side that contacts the blade and a second side that contacts the back-up roller.

11. The device of claim 8, wherein the transfer nip is positioned on a substantially vertical section of the intermediate transfer member and the cleaner unit is positioned on a substantially horizontal section of the intermediate transfer member.

12. The device of claim 8, wherein the cleaner unit contacts the intermediate transfer member at a position where the intermediate transfer member is in contact with the back-up roller.

13. The device of claim 12, wherein the back-up roller includes a diameter of between about 17 mm and about 25 mm.

14. The device of claim 12, further comprising a fuser unit forming a fuser nip, wherein a media path extends in substantially a straight line between the transfer nip and the fuser nip and the cleaner unit is positioned away from the media path to prevent contact with the media sheet.

15. The device of claim 8, wherein the cleaner unit is positioned vertically above the transfer roller.

16. An image forming device comprising:

an image forming unit to form a toner image;

an intermediate transfer member rotatably mounted to receive the toner image from the image forming unit, the intermediate transfer member including a first side that receives the toner image and a second side;

a back-up roller positioned in contact with the second side of the intermediate transfer member;

a transfer roller in contact with the first side of the intermediate transfer member and forming a transfer nip with the back-up roller to transfer the toner image to a media sheet; and a cleaner unit including a housing having a bracket attached to a lower portion thereof the bracket securing a blade so as to contact with the first side of the intermediate transfer member and downstream from the transfer roller relative to rotation of the intermediate transfer member, the cleaner unit positioned vertically above and abutting the first side of the intermediate transfer member at a position where the second side of the intermediate transfer member contacts the back-up roller to remove waste toner from the intermediate transfer member, the housing having a curved inner surface and including a planar portion extending outwardly from the housing to which a planar portion of the bracket is attached.

17. The device of claim 16, wherein the cleaner unit comprising a seal with an opening formed between the blade and the seal, the opening leading into an interior space that includes an auger.

18. The device of claim 17, wherein the blade is positioned vertically below the auger.

19. The device of claim 16, wherein the cleaner unit is positioned on a substantially horizontal section of the intermediate transfer member and the transfer roller is positioned on a substantially vertical section of the intermediate transfer member.

20. The device of claim 16, further comprising a fuser unit forming a fuser nip, wherein a media path extends in substantially a straight line between the transfer nip and the fuser nip and the cleaner unit is positioned away from the media path to prevent contact with the media sheet.

* * * * *